US006764134B1

(12) United States Patent
Crescenzi et al.

(10) Patent No.: US 6,764,134 B1
(45) Date of Patent: Jul. 20, 2004

(54) TRAVEL WRAP

(76) Inventors: Denise Crescenzi, 6 Kimber Ave., Middleton, MA (US) 01949; Arron Lanphear, 6 Kimber Ave., Middleton, MA (US) 01949; Michael Wilson, 26 Chilton St., Cambridge, MA (US) 02138

( * ) Notice: Subject to any disclaimer, the term of this patent is extended or adjusted under 35 U.S.C. 154(b) by 0 days.

(21) Appl. No.: 10/391,878

(22) Filed: Mar. 19, 2003

(51) Int. Cl.[7] ..... A47C 31/00

(52) U.S. Cl. ..... 297/219.12; 297/219.1; 297/184.13; 297/228.1

(58) Field of Search ..... 297/219.1, 219.12, 297/184.13, 228.1, 228.13

(56) References Cited

U.S. PATENT DOCUMENTS

| | | | | | |
|---|---|---|---|---|---|
| 1,051,566 | A | | 1/1913 | Dreher | |
| 1,538,538 | A | | 5/1925 | Wood | |
| 2,652,183 | A | | 9/1953 | Hlivka | |
| 4,273,380 | A | | 6/1981 | Silvestri | |
| 4,656,670 | A | | 4/1987 | Schluter | |
| 4,676,376 | A | | 6/1987 | Keiswetter | |
| 4,687,248 | A | | 8/1987 | Ross et al. | |
| 4,694,511 | A | | 9/1987 | Estes et al. | |
| 4,969,683 | A | * | 11/1990 | Wallace et al. | 297/250.1 |
| 4,993,090 | A | * | 2/1991 | Ranalli | 5/482 |
| 5,150,945 | A | * | 9/1992 | Aupperlee et al. | 297/184.13 |
| 5,243,724 | A | * | 9/1993 | Barnes | 5/482 |
| 5,437,061 | A | * | 8/1995 | Kenner | 2/69 |
| 5,611,095 | A | * | 3/1997 | Schneider | 5/482 |
| 5,662,380 | A | * | 9/1997 | Tam et al. | 297/354.12 |
| 5,707,107 | A | | 1/1998 | Melone | |
| 5,781,946 | A | * | 7/1998 | McEntire et al. | 5/482 |
| 5,806,925 | A | | 9/1998 | Hanley | |
| 5,918,933 | A | * | 7/1999 | Hutchinson et al. | 297/219.12 |
| 5,950,261 | A | * | 9/1999 | Hay et al. | 5/482 |
| 5,988,744 | A | * | 11/1999 | Franchak | 297/256.17 |
| 6,012,189 | A | * | 1/2000 | Dudley | 5/655 |
| 6,048,026 | A | | 4/2000 | Barnett et al. | |
| 6,145,932 | A | * | 11/2000 | Hamel-Nyhus et al. | 297/465 |
| 6,394,543 | B1 | * | 5/2002 | Dunne et al. | 297/219.12 |

* cited by examiner

*Primary Examiner*—Peter M. Cuomo
*Assistant Examiner*—Joseph Edell
(74) *Attorney, Agent, or Firm*—O'Connell Law Firm

(57) ABSTRACT

A travel wrap with a central portion for covering a seat structure, first and second wing members for selectively blanketing a seat occupant, and a cap portion for retaining the central portion relative to a seat. First and second apertures can receive seat belt straps to enable the seat occupant to be secured relative to the seat structure. Third and fourth apertures can enable the seat belt straps to be threaded through the travel wrap to allow the seat belt arrangement to be fastened exterior to a blanketed configuration of the wing members. The cap portion can have first and, possibly, second pockets for receiving the upper end of the seat back, and a pillow can be associated with one face of the travel wrap for enabling the travel wrap to be applied reversibly and to enable the selective provision of a pillow.

15 Claims, 7 Drawing Sheets

TRAVEL WRAP

FIELD OF THE INVENTION

The present invention relates generally to blankets and seat coverings. Stated more particularly, this patent discloses and protects a travel wrap comprising a combined seat cover and blanket for ensuring a sanitary seating arrangement while providing a seat occupant with access to the warmth, comfort, and privacy of a blanket.

BACKGROUND OF THE INVENTION

Seats in airplanes, buses, trains, and other vehicles must be used by countless travelers, typically unknown to one another, over a life span of perhaps many years. Similarly, business employees often must share a given seat with one or more coworkers, predecessors, or other seat occupants whose cleanliness, health, and tidiness are not necessarily certain. In these and other circumstances where multiple persons must use a single seat over time, the sanitary conditions of the seat cannot be ensured.

One will also be aware that there are many circumstances where a seat occupant will desire the warmth, comfort, and privacy that can be afforded by a blanket. This is particularly true for the traveling public for whom multiple idle hours in a given seat often leave the seat occupant with a desire to wrap him or herself in a blanket to allow a nap or simply some warmth, comfort, and privacy. Of course, numerous other seat occupants will have similar needs and desires.

It will be noted, of course, that the prior art has disclosed a plurality of arrangements for covering a seat. For example, a number of prior art arrangements can be employed in a multi-function format, such as in the form of a cover for a car seat and in an alternative application, such as in the form of a garment or a towel. Other prior art arrangements provide protective seat covers formed of polymeric films that can be clung temporarily to a seat and disposed of after a given period of usage. Still other arrangements are known wherein a particularly crafted seat covering can be removed and replaced relative to a seat structure to allow for cleaning, repair, and replacement of the seat covering.

Nonetheless, there does not appear to be any arrangement in the prior art that can satisfactorily provide a removable and replaceable covering that can be applied to a variety of seat structures to supply a comfortable, sanitary covering therefor while also supplying a seat occupant with access to a blanket when desired. With that in mind, it will be appreciated that the provision of a seat cover that can be used by travelers, office workers, and other seat occupants would be advantageous. It will be further appreciated that those same persons would also be well served by an invention that could provide them with a blanket when necessary or desirable. It is clearer still that an invention that could simultaneously provide a user with a comfortable, readily accessible blanket while also providing a reliable covering for a seat structure would represent a useful advance in the art.

SUMMARY OF THE INVENTION

Advantageously, the present invention is founded on the most basic object of providing a travel wrap comprising a combined seat cover and blanket that meets the needs left by the prior art while providing a number of further advantages thereover.

A more particular object of the invention is to provide a travel wrap that can be readily removed and replaced relative to a seating structure thereby enabling travelers, office workers, and other seat occupants to shield themselves from a seat of potentially unknown sanitary condition.

A further particular object of the invention is to provide a travel wrap that can be employed as a blanket thereby providing a seat occupant with access to warmth, comfort, and privacy.

An additional object of the invention is to provide a travel wrap that can be comfortably applied to seat structures of a wide variety of types.

An even further object of the invention is to provide a travel wrap that can allow a seat occupant to wear a fastened seat belt both while the travel wrap is disposed to provide the seat occupant with a blanket and while the travel wrap is in a non-blanketed configuration.

In particular embodiments, a further object of the invention is to provide such a travel wrap that can enable a fastened seat belt to be disposed outside of a blanket enclosure thereby enabling visual verification of the fastened status of the seat belt. These and further objects and advantages of the invention will become obvious not only to one who reviews the present specification and drawings but also to one who has an opportunity to make use of an embodiment of the present invention for a travel wrap. However, it will be appreciated that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the present invention.

In carrying forth these and further objects, a most basic embodiment of the travel wrap can be applied easily to a seat structure to provide a seat occupant with access to a blanketing enclosure and to provide a sanitary covering for the seat structure. The travel wrap can include a central portion of cloth material for overlying at least a portion of the seat structure. A first wing member of cloth material can be coupled to a first side of the central portion, and a second wing member of cloth material can be coupled to a second side of the central portion. A means for retaining an upper distal end of the central portion relative to the seat back can assist in retaining the travel wrap relative to the seat structure. Under this arrangement, the travel wrap can be employed in a non-blanketed configuration with the first and second wing members not blanketing the seat occupant and the travel wrap can be employed in a blanketed configuration with the first and second wing members blanketing the seat occupant.

In certain embodiments, a first aperture can be disposed adjacent to the first side of the central portion and a second aperture can be disposed adjacent to the second side of the central portion. With that, a first seat belt strap of a seat belt arrangement can be passed through the first aperture and a second seat belt strap can be passed through the second aperture such that the seat belt arrangement can be fastened about the seat occupant. The central portion can include a back panel member for overlying the seat back and a seat panel member for overlying the seat bottom, and the first and second apertures can be disposed adjacent to a lower end of the back panel member adjacent to the intersection between the back panel member and the seat panel member. Of course, although they could be formed separately and joined together, the back panel member and the seat panel member, and indeed the first and second wing members as well, can be crafted from a single piece of cloth. In any case, the first and second wing members can in certain embodiments extend beyond a distal end of the seat panel member while an upper end of the back panel member can extend beyond the first and second wing members.

Where necessary or desirable, a fin can be coupled to the central portion adjacent to the intersection between the back panel member and the seat panel member such that it can be pressed into place between the seat back and the seat bottom to retain the travel wrap relative to the seat structure most effectively. The fin can have a widened distal portion, which can be formed by a bar or the like, for better retaining it relative to the seat structure.

Where it may be necessary or desirable to ensure that the fastening status of the seat belt arrangement remain independently verifiable, third and fourth apertures can be disposed in the first and second wing members spaced a given lateral distance from the first and second apertures respectively. With that, the first seat belt strap can be threaded first through the first aperture and then through the third aperture and the second seat belt strap can be threaded first through the second aperture and then through the fourth aperture. When the first and second seat belt straps are so threaded, the seat occupant can be blanketed by the first and second wing members and the fastening status of the seat belt arrangement can remain independently verifiable.

The means for retaining the upper distal end of the central portion relative to the seat back can take the form of a cap portion with a first pocket capable of receiving an upper end of the seat back, and, in certain cases, the first pocket can be supplemented by a second pocket with the pockets disposed to opposite faces of the central portion. Under such an arrangement, the travel wrap can be reversibly applied to the seat structure. In some embodiments, a pillow can be associated with one face of the central portion. Where two pockets and a pillow are provided, the seat occupant can advantageously select whether to have the pillow interposed between him or herself and the seat structure or not by employing either the first pocket or the second pocket to have either a first face or a second face of the travel wrap face him or her. In any case, either or both of the pockets can be formed from or incorporate an elastic material for accommodating the upper end of the seat back.

The travel wrap can be disposed and maintained in a packed configuration with the use of a strap or straps that retain some or all of the travel wrap within the pocket or pockets. Where only one pocket is provided, the strap or straps can be fixed, for example, adjacent to the second pocket. The first and second wings can then be folded upon the central portion and then the joined arrangement can be rolled or folded and pressed into a pocket. Then, the strap or straps can be tied off to retain the travel wrap in the packed configuration for storage and transport.

One will appreciate that the foregoing discussion broadly outlines the more important features of the invention to enable a better understanding of the detailed description that follows and to instill a better appreciation of the inventors' contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

As with many inventions, the present invention for a travel wrap can assume a wide variety of embodiments. However, to assist those reviewing the present disclosure in understanding and, in appropriate circumstances, practicing the present invention, certain exemplary embodiments of the travel wrap are described below and shown in the accompanying drawing figures.

Figure 1:
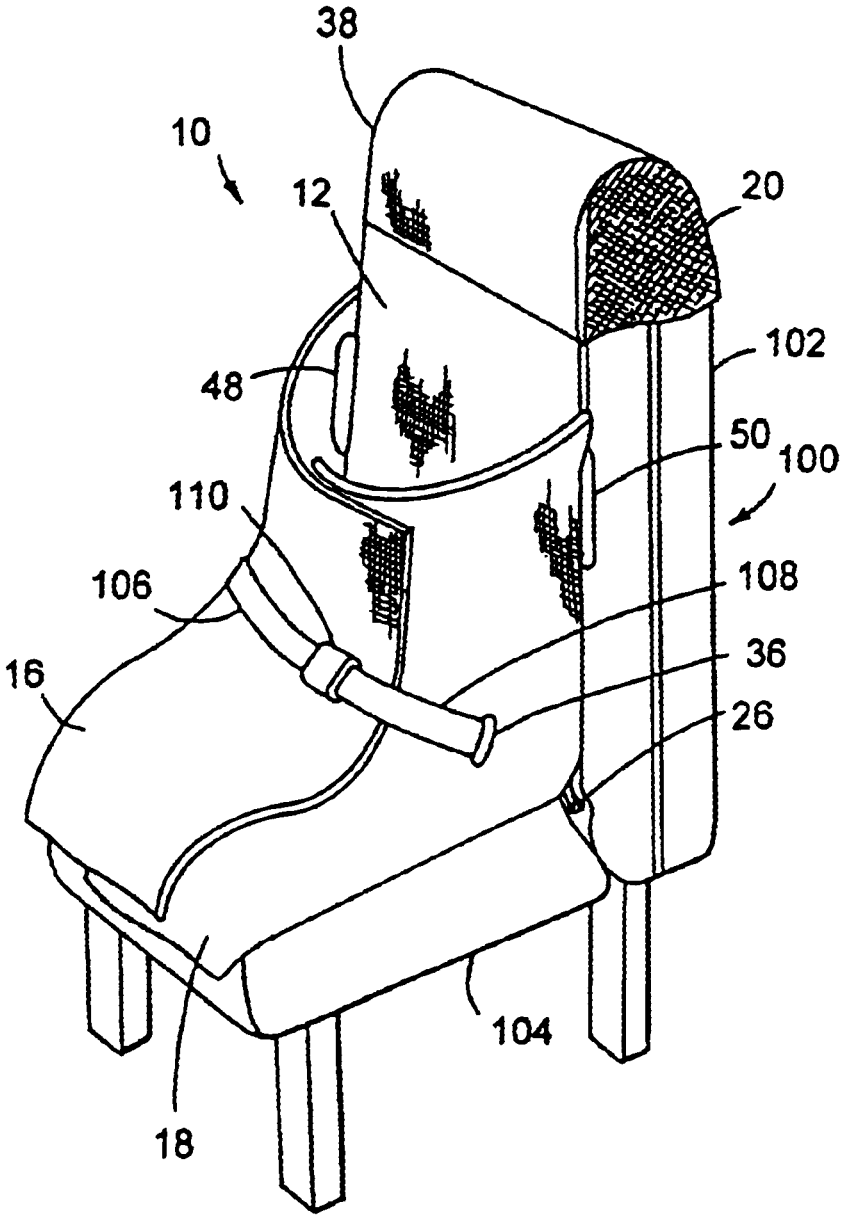
FIG. 1 is a perspective view of a travel wrap according to the present invention shown disposed relative to a seat structure in a closed blanket configuration.
Figure 2:
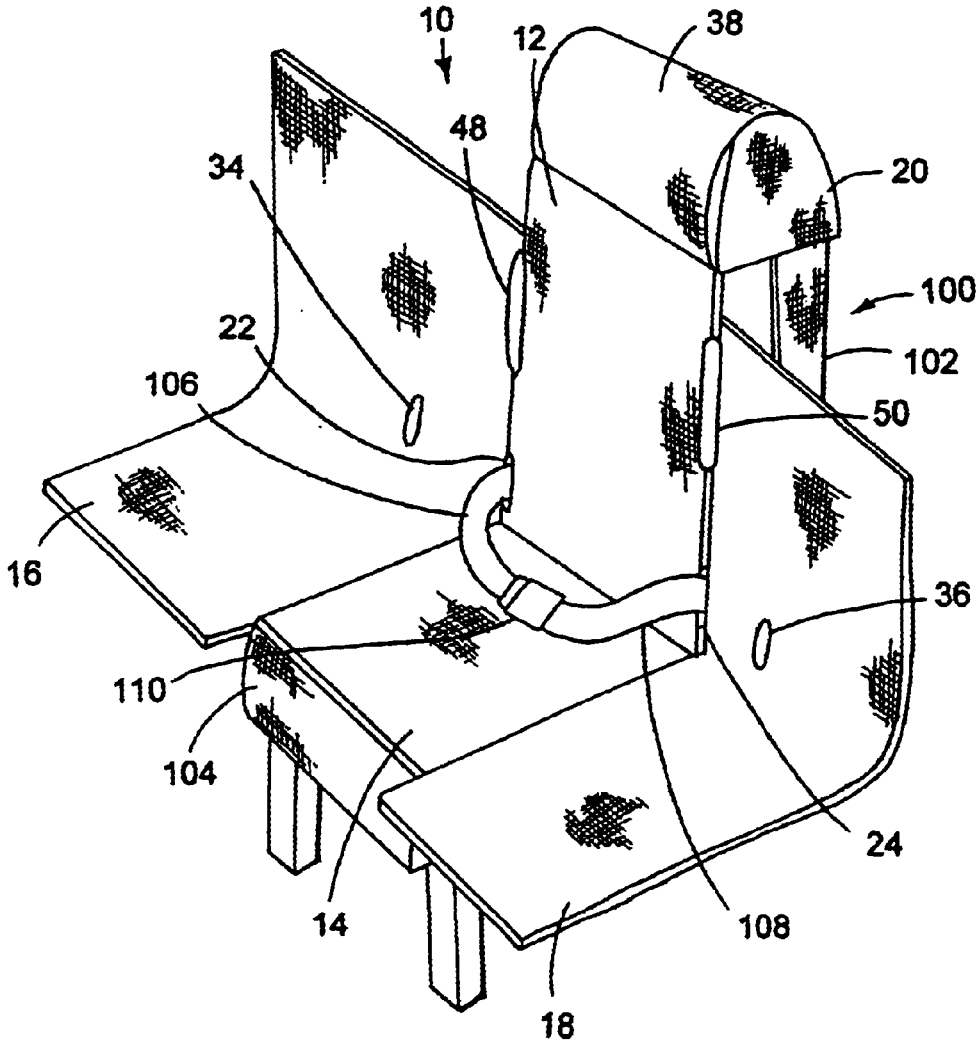
FIG. 2 is a perspective view of the travel wrap of FIG. 1 in an open blanket configuration disposed relative to a seat structure.
Figure 3:
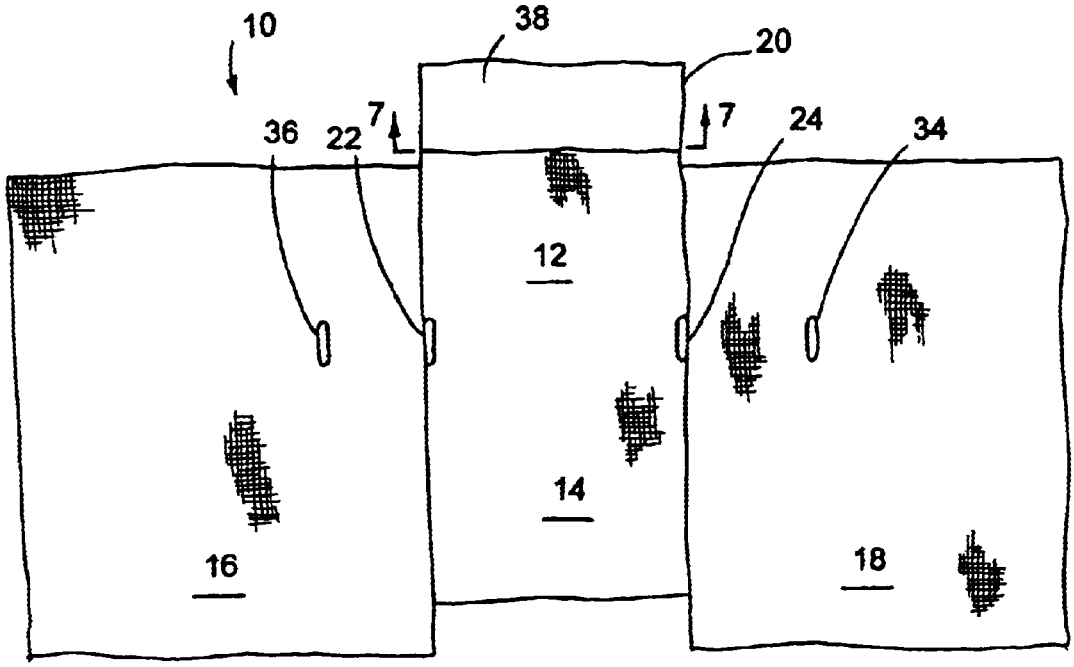
FIG. 3 is a view in front elevation of the travel wrap in an open blanket configuration separate from any seat structure.

Looking more particularly to the drawings, a first preferred embodiment of the present invention for a travel wrap is indicated generally at 10 in FIGS. 1 through 4. In FIGS. 1 and 2, the travel wrap 10 is shown as it might be associated with a seat structure 100, such as a seat on an airplane, train, bus, boat, car, or other vehicle, in an office or a home, or substantially any other type of seat. The travel wrap 10 has a central portion comprising a back panel member 12 for overlying a seat back 102 and a seat panel member 14 for overlying a seat bottom 104. A cap structure 20 is disposed at an upper end of the back panel member 12 for receiving an upper end portion of the seat back 102 thereby to retain the travel wrap 10 relative to the seat structure 100. A first wing member 16 extends from a first side of the back panel member 12 and the seat panel member 14 while a second wing member 18 extends from a second side of the back and seat panel members 12 and 14.

In this exemplary arrangement, the back panel member 12, the seat panel member 14, and the first and second wing members 16 and 18 are each generally rectangular. However, it will be appreciated that one or more of the back panel member 12, the seat panel member 14, or the first and second wing members 16 and 18 can be differently formed. For example, in certain embodiments, the back panel member 12 and the seat panel member 14 can be contoured or otherwise shaped to adapt to certain or typical seat configurations. Similarly, the first and second wing members 16 and 18 could be rounded or otherwise alternatively configured to accomplish their primary purpose of blanketing a user most advantageously. Furthermore, the back panel member 12, the seat panel member 14, and the first and second wing members 16 and 18 could be formed from numerous different cloth materials including cotton, a synthetic material, or a cotton and synthetic blend. In any case, however, it will be preferred that the chosen cloth material will be flame retardant. Within the terms of this disclosure, the term cloth shall be considered to include any pliable material, whether made by a weaving, felting, or knitting of natural or synthetic fibers or filaments.

Still further, one will note that the dimensions of the components of the travel wrap 10 can be varied within the scope of the invention. In one presently preferred embodiment, the back panel member 12 and the seat panel member 14 can each have a width of approximately 20 inches and a combined length of approximately 55 inches. The first and second wing members 16 and 18 can each have an overall width of roughly 36 inches and a length of approximately 50 inches. Preferably, what may be considered the lower end of the first and second wing members 16 and 18 will extend beyond the distal end of the seat panel member 14 by a given amount, such as by approximately 5 inches, and the distal end of the back panel member 12 will extend beyond what may be considered the upper end of the first and second wing members 16 by a given amount, such as by approximately 10 inches. Under such an arrangement, the first and second wing members 16 and 18 can blanket a user most effectively without being interfered with by the central portion of the travel wrap 10 and while remaining ergonomically comfortable in use by the typical seat occupant.

As can be seen by combined reference to FIGS. 1 through 4 and FIG. 7, the cap portion 20 in this preferred embodiment is formed with a first panel 44 and a second panel 46 that effectively sandwich the distal end portion of the back panel member 12. A pillow 38 is incorporated into or otherwise coupled to the first panel 44 while the second panel 46 in this embodiment does not include a pillow. The first and second panels 44 and 46 cooperate with the back panel member 12 to form respective first and second pockets 40 and 42 that are capable of receiving a typical upper end portion of a seat back 102. Of course, it is possible and may indeed be preferable in many circumstances simply to have only a first pocket 40.

The ability of the pockets 40 and 42 to receive the upper end portion of the seat back 102 can be carried out in a number of ways. For example, the first and second pockets 40 and 42 can simply be preformed with openings large enough to receive the upper end portion of the seat back 102. Alternatively, either or both of the first and second panels 44 and 46 and the back panel member 12 can be crafted from a resiliently stretchable material such that the first and second pockets 40 and 42 can expand as necessary to adapt to seat structures 100 of varying sizes and to ensure a secure frictional engagement between the travel wrap 10 and the seat structure 100. In this exemplary embodiment, the first panel 44 is formed from a resiliently stretchable panel of fabric material and the second panel 46 is formed from a resiliently stretchable netting material. In both cases, however, it should be clear that the particular material chosen can vary widely depending, for example, on the particular application, the perceived needs of the end user, and manufacturing considerations. For example, the first and second panels 44 and 46 could be formed advantageously from a cotton, a synthetic, a cotton and synthetic material blend, a fabric incorporating strips of elastic material, a fabric or netting incorporating resilient polymeric material, or any other suitable material including the same material that forms the remaining components of the travel wrap 10. Although a resilient material may be advantageous in certain circumstances, it will be appreciated that other circumstances may warrant the use of generally non-resilient material for the first and second panels 44 and 46 and the cap 20 in general.

Figure 5:
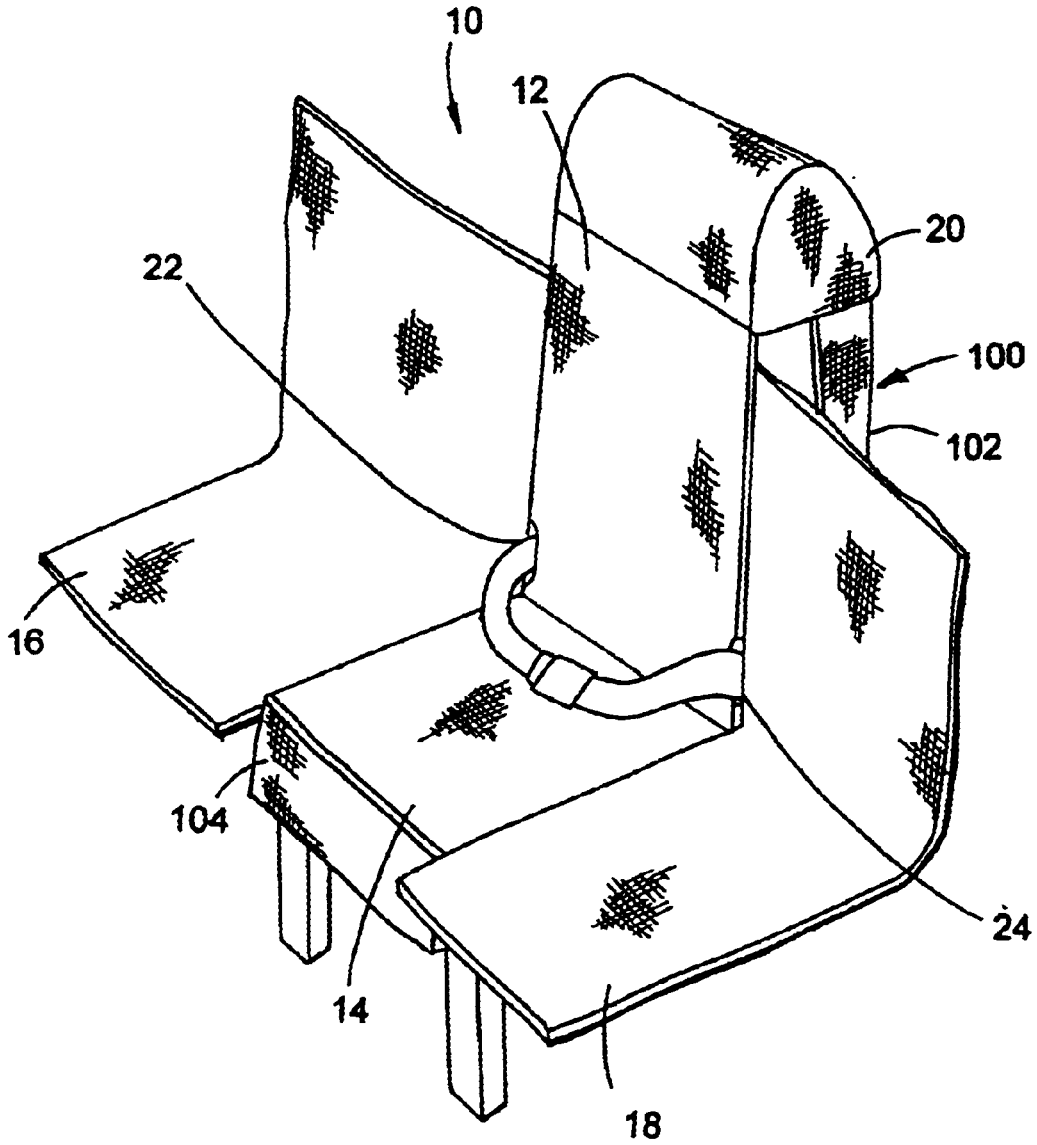
FIG. 5 is a perspective view of an alternative embodiment of the travel wrap in an open blanket configuration disposed relative to a seat structure.

As can be seen most clearly in FIGS. 2 and 5, first and second seat belt apertures 22 and 24 are provided in the travel wrap 10 for enabling the first and second straps 106 and 108 and buckle elements 110 of a typical vehicular lap belt seat belt arrangement to be passed therethrough. The first and second seat belt apertures 22 and 24 in this exemplary embodiment essentially comprise reinforced slots. The apertures 22 and 24 are preferably located adjacent to the base of the back panel member 12 proximal to its intersection with the base panel member 14 and generally at the respective intersection of the back panel member 12 with each of the first and second wing members 16 and 18.

Under this arrangement, the travel wrap 10 can be applied to a seat structure 100 as is shown, for example, in FIG. 2. The straps 106 and 108 can be passed from what can be considered the seat side of the travel wrap 10, through the respective apertures 22 and 24, and to what can be considered the seat occupant side of the travel wrap 10. With the straps 106 and 108 so disposed, the seat occupant can belt him or herself into the seat structure 100 for safety and, in many cases, to comply with transportation rules. When necessary or desirable, the first and second wing members 16 and 18 can then be wrapped around the seat occupant to achieve the closed blanket configuration shown, for example, in FIGS. 1 and 6 thereby blanketing the seat occupant to provide warmth, comfort, and privacy. Advantageously, when the straps 106 and 108 are disposed through the apertures 22 and 24, they will anchor the travel wrap 10 so that it will be better retained in position relative to the seat structure 100.

Figure 6:
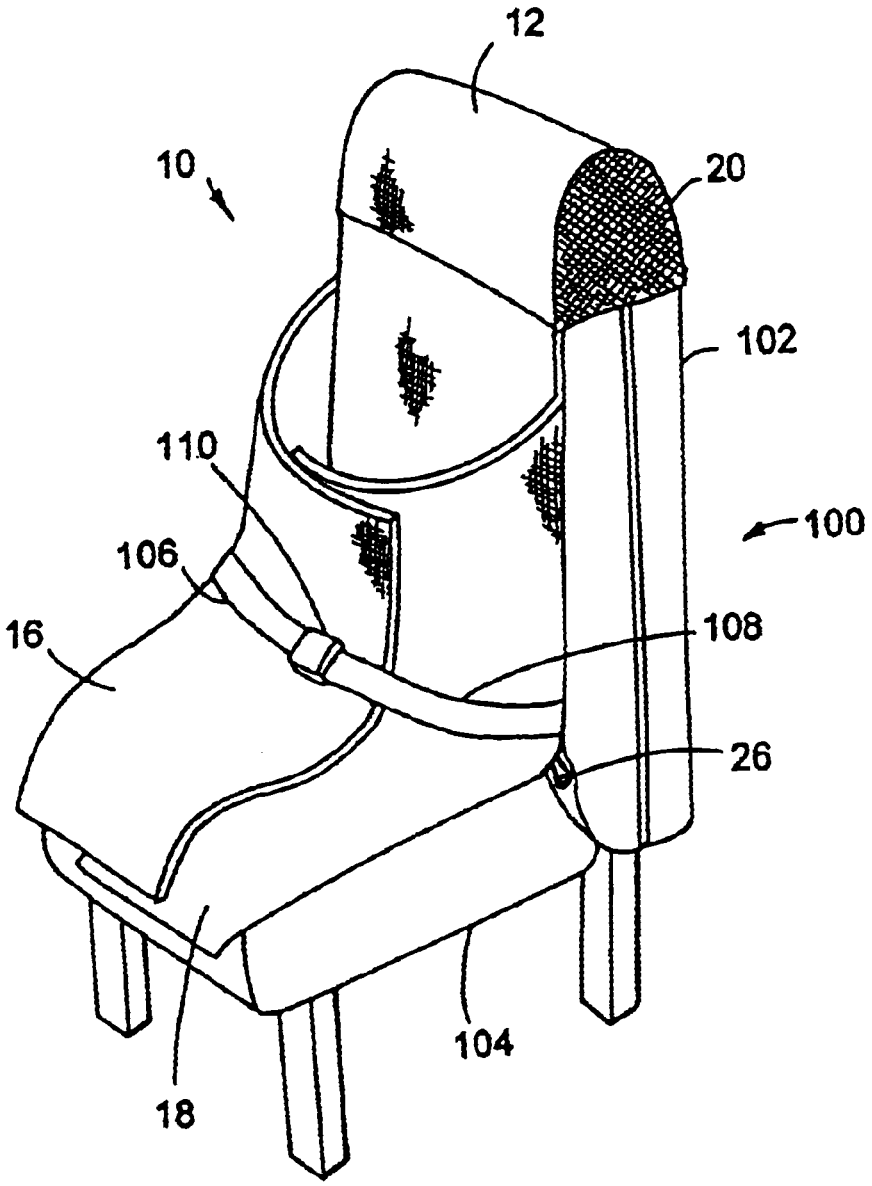
FIG. 6 is a perspective view of the travel wrap of FIG. 5 in a closed blanket configuration disposed relative to a seat structure.
Figure 7:
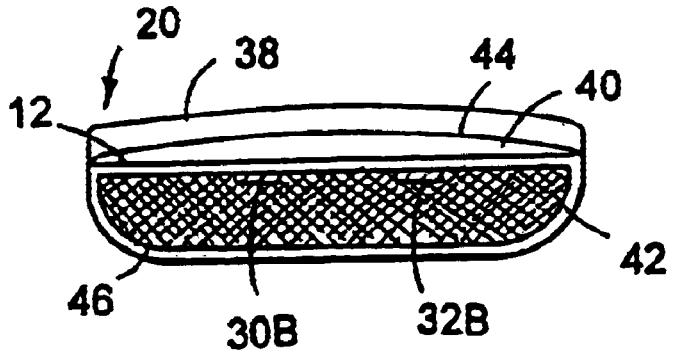
FIG. 7 is a cross sectional view of the travel wrap taken along the line 7—7 in FIG. 3.

It will be seen that only first and second seat belt apertures 22 and 24 are provided in the embodiment of the travel wrap 10 of FIGS. 5 and 6. With that, when the first and second straps 106 and 108 are passed through the apertures 22 and 24 and the first and second wing members 16 and 18 are disposed in a closed blanket configuration, the status of the seat belt arrangement, namely whether it is fastened or unfastened, will be obscured. In many circumstances, such as in a car or bus, this may be entirely permissible, even desirable. However, on airplanes and in certain other circumstances, the status of the seat belt arrangement must be verifiable to, for example, the flight staff. Consequently, where the first and second straps 106 and 108 are so disposed, the flight staff or other personnel may find it necessary to disturb the seat occupant to ascertain whether the seat belt arrangement is fastened. The seat occupant can prevent this by either not passing the first and second straps 106 and 108 through the apertures 22 and 24 or, if they have already been so passed, by passing them back through the apertures 22 and 24 and then securing the seat belt arrangement outside of the closed blanket configuration as is shown in FIG. 6 so that the fastened status of the seat belt arrangement can be readily verified without disturbance to the seat occupant.

Although the embodiment as heretofore described certainly will be advantageous in many applications, one will appreciate that there may be circumstances where it will be necessary to pass and re-pass the straps 106 and 108 through the apertures 22 and 24 to the point where doing so will become cumbersome. For example, over the length of a given trip, an airplane seat occupant may have a number of occasions when he or she will wish to be blanketed and a number of other occasions when he or she will not wish to be covered by a blanket. With each occasion when the airplane seat occupant will wish to sit without a blanket, he or she will preferably ensure that the straps 106 and 108 are passed through the apertures 22 and 24. With each occasion when the airplane seat occupant will wish to be blanketed, he or she may need to pass the straps 106 and 108 back through the apertures 22 and 24 so that the fastening status of the seat belt arrangement can be verified. In addition to the inconvenient nature of these tasks in general, one will appreciate that these repeated adjustments of the seat belt arrangement can prove particularly disadvantageous when the straps 106 and 108 are not disposed through the apertures 22 and 24 and the travel wrap 10 shields the straps 106 and 108 from view such that locating them to pass them through the apertures 22 and 24 could prove to be a difficult task in and of itself.

Of course, one will note that it could be possible to bypass the apertures 22 and 24 completely such that the travel wrap 10 would simply be retained relative to a seat structure 100 by passing the cap portion 20 over the upper end of the seat back 102 and fastening and unfastening the seat belt arrangement as necessary either with the travel wrap 10 in a blanketed or non-blanketed arrangement. However, doing so can be considered disadvantageous for a number of reasons. For example, the lower portion of the travel wrap 10 will not be maintained in a properly aligned orientation relative to the seat structure 100. Also, where the seat occupant wishes to have the seat belt arrangement fastened without being covered by the first and second wing members 16 and 18, the travel wrap 10 may bunch up and otherwise render the seat occupant uncomfortable.

Advantageously, many of these issues can be obviated under the embodiment of FIGS. 1 through 4 where the first and second apertures 22 and 24 are supplemented by third and fourth apertures 34 and 36 with the third aperture 34 comprising a reinforced slot disposed in the first wing member 16 and the fourth aperture comprising a reinforced slot disposed in the second wing member 18. More particularly, the third aperture 34 is laterally spaced along the first wing member 16 relative to the first aperture 22 by a given distance while the fourth aperture 36 is laterally spaced along the second wing member 18 relative to the second aperture 24 by a given distance. Like the first and second apertures 22 and 24, each of the third and fourth apertures 34 and 36 are sized to receive the first and second straps 106 and 108 and the buckle elements 110 therethrough.

Under this arrangement, the seat occupant can initially dispose the travel wrap 10 as is shown, for example, in FIG. 1. There, the first and second seat belt straps 106 and 108 are received through the first and second apertures 22 and 24 respectively such that the seat belt arrangement can be readily employed for securing the seat occupant when the first and second wing members 16 and 18 are to be left in an open or non-blanketed configuration and when the wing members 16 and 18 are disposed in a closed blanket configuration provided the fastening status of the seat belt arrangement need not be verifiable. However, in situations where the fastening status of the seat belt arrangement must be independently verifiable or where the seat occupant simply wishes to have the seat belt arrangement primarily disposed outside of the closed blanket configuration, the seat occupant need only pass the distal ends of the first and second straps 106 and 108 through the third and fourth apertures 34 and 36 respectively. With that, the straps 106 and 108 will be essentially threaded through the travel wrap 10, passing first through the first and second apertures 22 and 24 to what can be considered the occupant side of the travel wrap 10 and then through the third and fourth apertures 34 and 36 to what can be considered the exterior side of the travel wrap 10. Then, the first and second wing members 16 and 18 can be folded to a closed blanket configuration and the seat belt arrangement can be fastened in an independently verifiable manner as is shown in FIG. 1. When the occupant again wishes to sit without the first and second wing members 16 and 18 in a closed configuration, he or she need only unfasten the buckle elements 1 10 and, if necessary or desirable, remove the first and second straps 106 and 108 from the third and fourth apertures 34 and 36.

The travel wrap 10 can be further refined by the addition of first and second armholes 48 and 50 as is shown in FIGS. 1 and 2. There, the armholes 48 and 50 are disposed generally at the junction between the back panel member 12 and the first and second wing members 16 and 18 respectively for aligning with the shoulders of the seat occupant. In this exemplary embodiment, the armholes 48 and 50 essentially comprise slits or other apertures of, for example, 10" to 12" long that begin at about 18" to 24" from the base of the back panel member 12. Of course, the armholes 48 and 50 could be of different dimensions, shapes, and locations within the scope of the invention. Under such an arrangement, the seat occupant could conveniently pass his or her arms through the armholes 48 and 50 while enjoying the covering provided by the remainder of the travel wrap 10.

Figure 4:
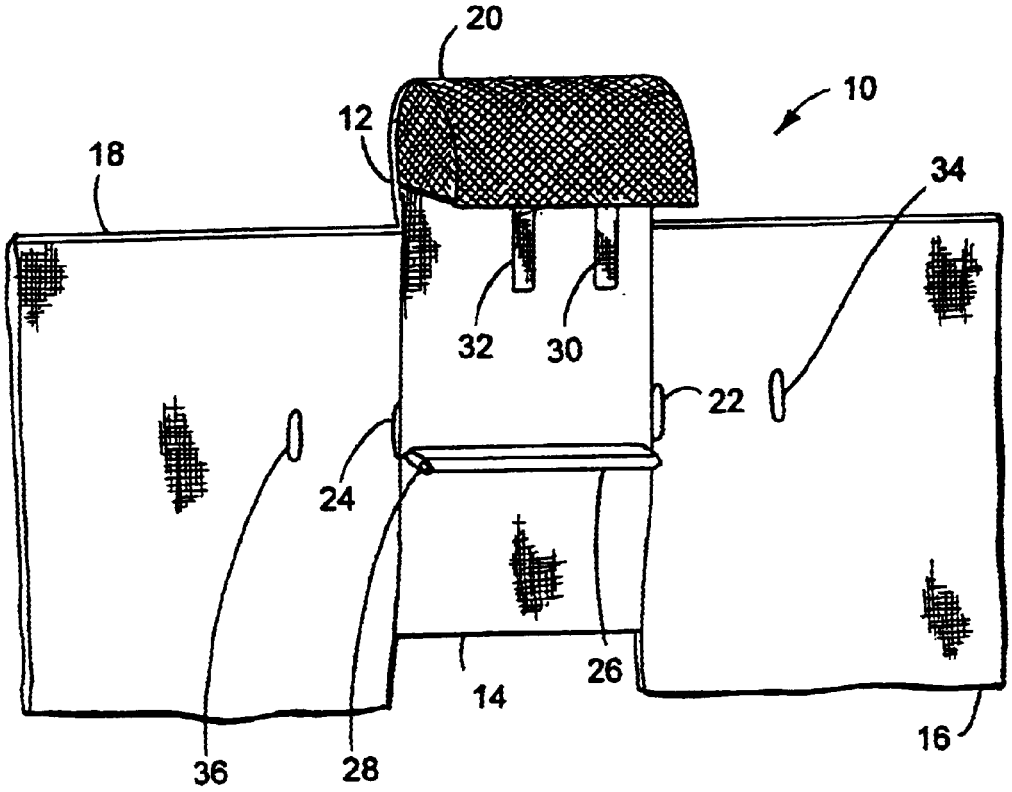
FIG. 4 is a rear perspective view of the travel wrap again shown in an open blanket configuration separate from any seat structure.

Certain embodiments of the travel wrap 10 can further include a supplemental means for retaining the base of the back panel member 12 relative to the base of the seat back 102. As is shown in FIGS. 1 and 4, one preferred retaining means comprises a fin 26 extending from the base of the back panel member 12 with a widened distal portion that can be formed by a bar 28 or any other appropriate structure. Under such an arrangement, the fin 26 and the bar 28 can be pressed between the adjacent surfaces of the seat back 102 and the seat bottom 104 thereby to be retained frictionally to retain the travel wrap 10 in a secure manner over substantially its entire base portion.

Figure 8:
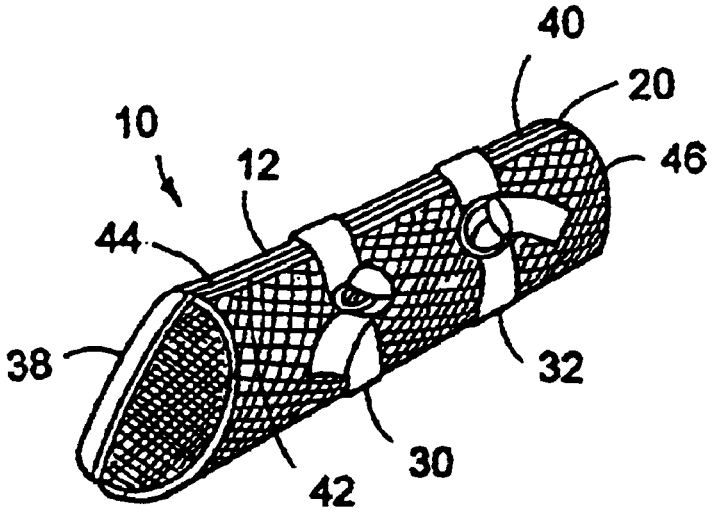
FIG. 8 is a perspective view of the travel wrap in a packed configuration.

In any event, one will note that, by its nature and design, the travel wrap 10 will preferably be capable of being readily stored and transported so that the user can conveniently carry it with him or her to be applied to any seat structure 100 he or she may desire. Advantageously, each of the exemplary embodiments disclosed herein can be easily arranged into a packed configuration as is shown, by way of example, in FIG. 8. While it is readily possible that such a packed configuration could be achieved without them, the packing of the travel wrap 10 in this embodiment is facilitated by first and second straps 30 and 32 that can extend, for example, from the rear side of the back panel member 12 adjacent to the second pocket 42 as is exemplified in FIGS. 4 and 7. Under one practice, the user can fold the first and second wing members 16 and 18 over the back and seat panel members 12 and 14 and the combined elements can be rolled and pressed into either the first pocket 40 or the second pocket 42. Of course, where only a first pocket 40 is provided, the combined elements will necessarily be pressed into that pocket 40. With the travel wrap 10 so arranged, the first and second straps 30 and 32 can be tied off to retain the travel wrap 10 in the packed configuration shown in FIG. 8 for transport and storage. Of course, further or separate straps or other securing means could be provided.

Where first and second pockets 40 and 42 are provided, the travel wrap 10 advantageously can be employed reversibly relative to a seat structure 100. For example, where a first side of the travel wrap 10 is to face the seat occupant, the upper end of the seat back 102 can be received into the second pocket 42. Where the travel wrap 10 includes a pillow 38 applied to or incorporated within the first panel 44, the pillow 38 will be provided to the seat occupant for enhancing his or her comfort where a pillow is necessary or desirable. Alternatively, the upper end of the seat back 102 can be received into the first pocket 40 such that a second side of the travel wrap 10 will face the seat occupant. With this, the seat occupant will have the option of not having the pillow 38 where it is not needed or not desired. Furthermore, because the travel wrap 10 is reversible, the seat occupant can select which side of the travel wrap 10 will face him or her to allow, for example, the seat occupant to enjoy a clean side of the travel wrap 10 where necessary and, where the different faces of the travel wrap 10 have different material properties, to select which face is more preferable in any given circumstance.

With a plurality of exemplary embodiments of the present invention for a travel wrap 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all features of the preferred embodiments.

Therefore, the following claims are intended to define the scope of protection to be afforded to the inventors However, those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also equivalents thereof.

We claim:

1. A travel wrap for being applied to a seat structure with a seat back and a seat bottom to provide a seat occupant with access to a blanketing enclosure, the travel wrap comprising:

a central portion for overlying at least a portion of the seat structure wherein the central portion is formed from a cloth material and has a first side, a second side, a first face, a second face, an upper distal end, and a lower distal end;

a first wing member of cloth material coupled to the first side of the central portion;

a second wing member of cloth material coupled to the second side of the central portion; and a means for retaining the upper distal end of the central portion relative to the seat back comprising a cap portion with a first pocket capable of receiving an upper end of the seat back wherein the first pocket is disposed to the side of the first face of the central portion, and a second pocket capable of receiving the upper end of the seat back, wherein the second pocket is disposed to the side of the second face of the central portion whereby the travel wrap can be reversibly applied to the seat structure by a selective use of the first pocket or the second pocket for receiving the upper end of the seat back;

whereby the travel wrap can be employed in a non-blanketed configuration with the first and second wing members not blanketing the seat occupant and whereby the travel wrap can be employed in a blanketed configuration with the first and second wing members blanketing the seat occupant.

2. The travel wrap of claim 1 further comprising a first aperture disposed in the travel wrap adjacent to the first side of the central portion and a second aperture disposed in the travel wrap adjacent to the second side of the central portion whereby a first seat belt strap of a seat belt arrangement can be passed through the first aperture and a second seat belt strap can be passed through the second aperture whereby the seat belt arrangement can be fastened about the seat occupant while the travel wrap is applied to a seat structure.

3. The travel wrap of claim 2 wherein the central portion comprises a back panel member for overlying the seat back wherein the back panel member has an upper end comprising the upper distal end of the central portion and a lower end and wherein the first and second apertures are disposed adjacent to the lower end of the back panel member.

4. The travel wrap of claim 3 wherein the central portion further comprises a seat panel member for overlying the seat bottom wherein the seat panel member has a proximal end coupled to the lower end of the back panel member at an intersection between the back panel member and the seat panel member and a distal end comprising the lower distal end of the central portion.

5. The travel wrap of claim 4 wherein the first and second wing members extend beyond the distal end of the seat panel member and wherein the upper end of the back panel member extends beyond the first and second wing members.

6. The travel wrap of claim 4 further comprising a fin coupled to the central portion adjacent to the intersection between the back panel member and the seat panel member for being interposed between the seat back and the seat bottom of the seat structure to retain the travel wrap relative to the seat structure.

7. The travel wrap of claim 6 further comprising a widened distal portion of the fin.

8. The travel wrap of claim 2 further comprising a third aperture disposed in the first wing member spaced a given distance from the first aperture and a fourth aperture disposed in the second wing member spaced a given distance from the second aperture whereby the first seat belt strap can be threaded through the travel wrap first through the first aperture and then through the third aperture and whereby the second seat belt strap can be threaded through the travel wrap first through the second aperture and then through the fourth aperture whereby the seat occupant can be blanketed by the first and second wing members while enabling a fastening status of the seat belt arrangement to be independently verified.

9. The travel wrap of claim 8 wherein the third and fourth apertures are laterally spaced on the first and second wings relative to the first and second apertures respectively.

10. The travel wrap of claim 1 further comprising a pillow associated with the first face of the central portion whereby the travel wrap can be employed with or without the pillow being provided to the seat occupant.

11. The travel wrap of claim 1 wherein at least a portion of the second pocket is formed from an elastic material for accommodating the upper end of the seat back.

12. The travel wrap of claim 1 further comprising at least one strap for retaining the travel wrap in a packed configuration with at least a portion of the travel wrap disposed within the first pocket and the at least one strap retaining the at least a portion of the travel wrap so disposed.

13. A travel wrap for being applied to a seat structure with a seat back and a seat bottom to provide a seat occupant with access to a blanketing enclosure, the travel wrap comprising:

a central portion for overlying at least a portion of the seat structure wherein the central portion is formed from a cloth material and has a first side, a second side, a first face, a second face, an upper distal end, and a lower distal end;

a first wing member of cloth material coupled to the first side of the central portion;

a second wing member of cloth material coupled to the second side of the central portion;

a means for retaining the upper distal end of the central portion relative to the seat back comprising a cap portion with a first pocket capable of receiving an upper end of the seat back wherein the first pocket is disposed to the side of the first face of the central portion, and a second pocket capable of receiving the upper end of the seat back, wherein the second pocket is disposed to the side of the second face of the central portion and wherein each pocket is defined at least in part by an outer panel, at least a first strap is fixed adjacent to the second pocket for retaining the travel wrap in a packed configuration whereby at least a portion of the travel wrap can be disposed within either the first or the second pocket and the first strap can be tied off to retain the at least a portion of the travel wrap so disposed;

whereby the travel wrap can be employed in a non-blanketed configuration with the first and second wing members not blanketing the seat occupant and whereby the travel wrap can be employed in a blanketed configuration with the first and second wing members blanketing the seat occupant.

14. The travel wrap of claim 13 further comprising a first armhole disposed in the travel wrap adjacent to the first side of the central portion and a second armhole disposed in the travel wrap adjacent to the second side of the central portion wherein the first and second armholes are disposed to align with a seat occupant's shoulders when the travel wrap is applied to a seat whereby a seat occupant can pass a first arm through the first armhole and a second arm through the second armhole.

15. The travel wrap of claim 14 further comprising a first aperture disposed in the travel wrap adjacent to the first side of the central portion and a second aperture disposed in the travel wrap adjacent to the second side of the central portion whereby a first seat belt strap of a seat belt arrangement can be passed through the first aperture and a second seat belt strap can be passed through the second aperture whereby the seat belt arrangement can be fastened about the seat occupant while the travel wrap is applied to a seat structure.

* * * * *